United States Patent [19]

Bergstrom et al.

[11] 4,452,455

[45] Jun. 5, 1984

[54] PUZZLE GAME

[76] Inventors: Jon Bergstrom; Jerice Bergstrom, both of P.O. Box 378, Norwich, Vt. 05055

[21] Appl. No.: 423,775

[22] Filed: Sep. 27, 1982

[51] Int. Cl.[3] ..... A63F 9/08

[52] U.S. Cl. ..... 273/155; 273/142 HA; 273/241; 273/280; 273/284

[58] Field of Search ..... 273/153 R, 155, 142 HA, 273/241, 280, 284

[56] References Cited

U.S. PATENT DOCUMENTS

| | | | |
|---|---|---|---|
| 928,833 | 7/1909 | Zschokke | 273/284 X |
| 2,150,303 | 3/1939 | Walker | 273/142 HA |
| 2,215,696 | 9/1940 | Graves | 273/280 X |
| 3,030,112 | 4/1962 | Scharp | 273/241 |
| 3,588,113 | 6/1971 | Nelson | 273/284 |

FOREIGN PATENT DOCUMENTS 240048 9/1925 United Kingdom .

OTHER PUBLICATIONS

Stadium Checkers®, Schaper Toy Catalog, unnumbered page.

*Primary Examiner*—Anton O. Oechsle

*Attorney, Agent, or Firm*—Sughrue, Mion, Zinn, Macpeak and Seas

[57] ABSTRACT

A puzzle game comprises a base having a plurality of steps extending upwardly from a circular wall to a top platform. A circular well or raceway extends between the circular wall and the lower of the steps and receives a circular ring therein for rotation thereabout. A plurality of additional rings are rotatably supported on the steps and a center member is supported on the platform. The faces of the rings are slanted upwardly and have line indicia thereon forming a maze pattern. A player rotates the rings which come to a click-stop in a random manner. A maze is created from the outer edge of the device to the center member and vice versa. Scores are awarded to a player in proportion to the length a playing piece is moved by the player through the maze for a given time period. The highest score is awarded the player who negotiates a path through the maze with a playing piece within a specific time period.

10 Claims, 4 Drawing Figures

PUZZLE GAME

BACKGROUND OF THE INVENTION

1. Field of the Invention

This invention pertains to puzzle games of the type having individually rotatable concentric rings which, when they are stopped by friction means, have maze patterns thereon to be negotiated by a player or players with a playing piece.

2. Statement of the Prior Art

The prior art discloses game apparatus having stacked squares or rotatable stacked discs for playing word games or for progressing a game piece from an outer disc to an inner disc. Unlike Applicant's invention, these devices do not show a game apparatus having rotatable rings thereon for forming a maze through which a player attempts to negotiate a path from an edge of the device to the center in a given set time.

Representative of the prior art are the following list of patents:

| Patentee | U.S. Pat. No. | Issue Date |
|---|---|---|
| H. Eyles | 1,892,664 | Jan. 3, 1933 |
| S. A. Graves, Jr. | 2,215,696 | Sept. 24, 1940 |
| J. M. Buckley | 2,370,229 | Feb. 27, 1945 |
| L. S. Dalton | 2,378,979 | March 20, 1956 |
| W. W. S. Scharp | 3,030,112 | April 17, 1962 |

SUMMARY OF THE INVENTION

This invention relates to the construction of a puzzle game having a plurality of rotatable rings each of which have line indicia thereon for creating a puzzle pattern. A player rotates the rings which stop randomly creating a maze. A player attempts to negotiate a playing piece through the maze within a given set time. A score is awarded a player in proportion to the length a playing piece is moved through the maze for a specific time period.

It is an object of this invention to construct a puzzle game which will be simple to assemble and require no specific skill to play.

It is another object of this invention to construct a puzzle game having a plurality of rotatable concentric rings arranged in stacked formation.

It is still another object of this invention to construct a puzzle game having a plurality of rotatable concentric rings in stacked formation, each ring having individual braking means.

It is yet another object of this invention to construct a puzzle game having a plurality of rotatable concentric rings supported on a pyramid-like base having a stationary outer edge and a stationary center member.

And still another object of this invention is to construct a puzzle game having a plurality of rotatable concentric rings having slanted upper surfaces coincident with the upwardly slanted surface of the stationary outer upwardly extending wall of the device, said surfaces having a maze pattern thereon extending from the edge of the apparatus to a central member.

And yet another object of this invention is to construct a puzzle game having a plurality of individual rotatable concentric rings each of which has line indicia thereon so that upon rotation and stopping of the rings a maze pattern is created whereby a player attempts to negotiate through the maze from the edge of the device to the center member in a given time period.

These and other objects of this invention will become apparent from a reading of the specification when taken in conjunction with the annexed drawings.

DESCRIPTION OF THE PREFERRED EMBODIMENT

Figure 1:
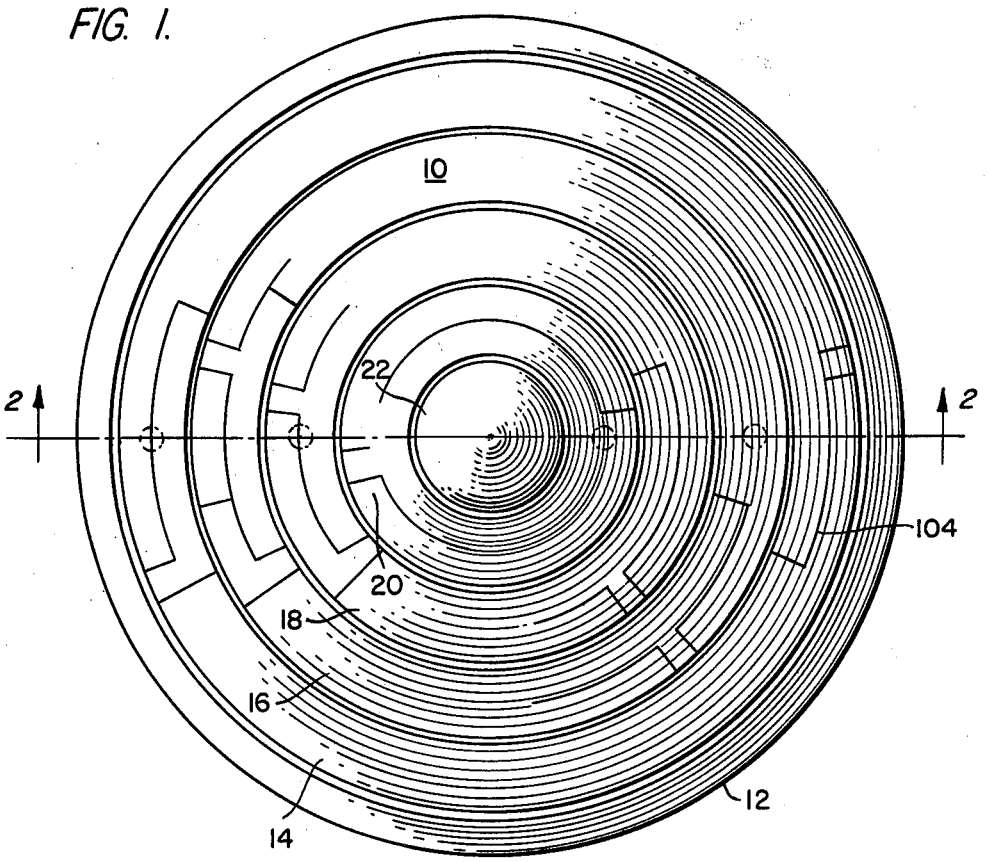
FIG. 1 is a plan view of the puzzle game showing the concentric rotatable rings with maze patterns thereon.
Figure 2:
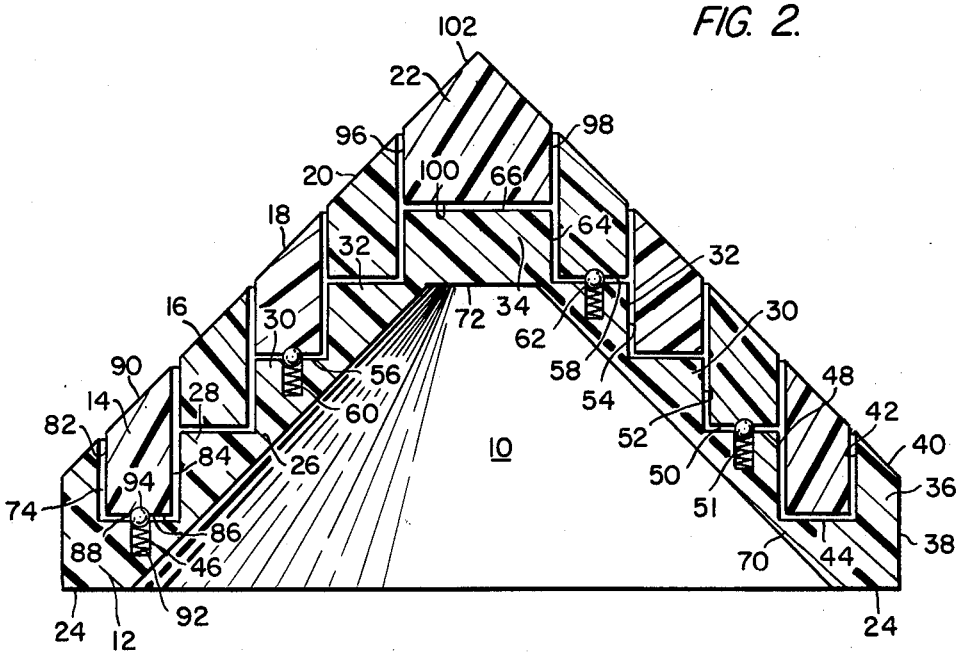
FIG. 2 is a side view in section taken along the line 2—2 of FIG. 1 showing a pyramid-like support base and a plurality of rotatable concentric rings having breaking means therefor.

Referring now in more detail to the drawings, in FIGS. 1 and 2 there is shown a puzzle game 10 having a base 12 in which there are set a plurality of rotatable concentric rings 14, 16, 18 and 20 and a center member 22.

The base 12 comprises a flat support surface 24, a vertically extending wall 26 having outer steps 28, 30, 32 and an upper platform 34. Extending from the base surface 24 is a vertical projecting wall 36 having an outer circular face 38, an upwardly slanted upper surface 40, an inner circular face 42 and a flat discs-like surface 44 having a plurality of slots 46 therein. The step 28 has a circular wall 48 and a flat surface 50 in which there are a plurality of slots 51. The steps 30 and 32 are identical to the step 28, each having circular walls 52 and 54 and flat disc-like surfaces 56 and 58. The surfaces 56 and 58 have a plurality of slots 60 and 62 therein. The upper platform 34 has a circular wall 64 and a flat surface 66. The support base 12 has an inner conical wall 70 terminating in a flat roof 72. The space between the wall 42 and 48 and the flat surface 44 defines a circular well or raceway 74 for the ring 14.

The ring 14 has circular walls 82 and 82, a flat bottom wall 86 having a plurality of spaced detents 88 therein and an upwardly slated face 90. Springs 92 in slots 46 urge balls 94 against the wall 86 and into the detents 88, the latter action providing a braking means for the ring 14 when same is rotated. The rings 16, 18 and 20 are identical to ring 14, each having the same braking action by means of the springs and balls and detents as shown. The upper center member 22 is disc-like in configuration having circular walls 96 and 98, a flat bottom wall 100 and an upwardly slated face 102.

On the face of each of the rings 14–20 there are line indicia, FIG. 1, forming a path for a playing piece. The line indicia or pattern 102 of each of the rings cooperate together to form a maze when the rings are stationary.

In operation, each player takes turns to spin each of the rings which will come to a click-stop at random. When all of the rings are stationary, a maze pattern will be created from the face 40 of the vertical projection 36 to the face of the center member 22 and vice versa. The object is for a player to negotiate a path through the maze in the quickest time possible. A stop clock may be used to set a specific time in which to negotiate the maze. Completing the maze within a specific given time gives the maximum score to that player. A proportionally smaller score is awarded for a partially completed path through the maze.

The maze may be constructed so that the scores would be awarded in favor of a player moving a playing piece onto specific sectors of each of the rings. By this construction, a player may achieve a higher score than an opponent by reaching a higher scoring sector of a given ring even though an opponent may have crossed more rings.

In addition, a player could, upon reaching a specific ring, accept a penalty and spin one or more rings ahead of his position if he believed that a new alignment would allow a higher score. The penalty would require him to return to the start and attempt a new route.

As a further modification, the path through the maze could be marked either by an overlay of tracing paper or by wax pencil directly on the maze. This path could be made to be recorded electronically by an electronic device.

Figure 3:
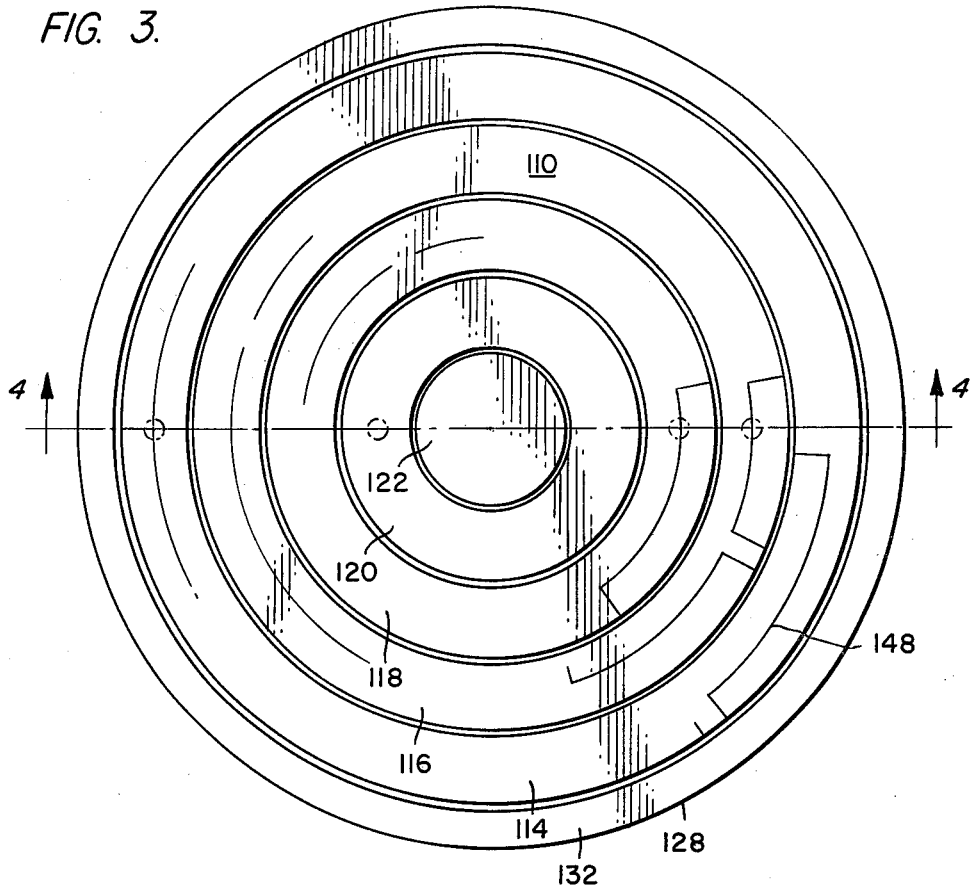
FIG. 3 is a plan view of a modified form of the puzzle game of FIG. 1 showing rotatable concentric rings with maze patterns thereon within a support housing.
Figure 4:
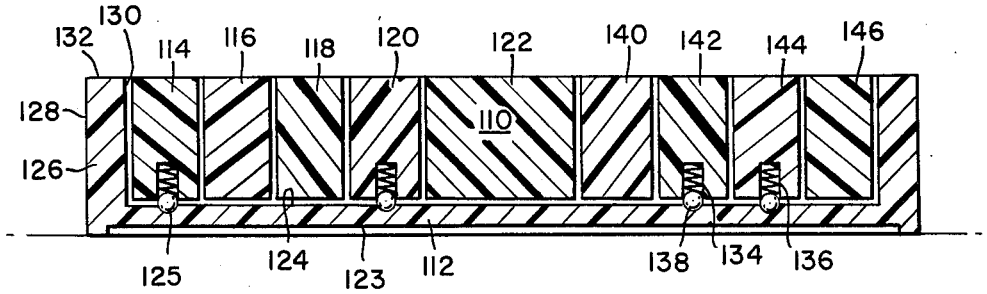
FIG. 4 is a side view in section taken along the line 4—4 of FIG. 3 and showing a plurality of rotatable concentric rings and breaking means therefor within a support housing.

In FIGS. 3 and 4, there is shown a modification of the device of FIGS. 1 and 2. The puzzle game 110 has a base 112 in which there are set a plurality of rotatable concentric rings 114, 116, 118 and 120 and a center member 122. The base 112 has an outside flat wall 123, an inside bottom 124 having a plurality of detents 125 therein and a circular upwardly extending wall 126 having an outside surface 128, an inside surface 130 and a top face 132. The base 112 and the wall 128 define a housing for the rotatable concentric rings. Each ring has a plurality of slots 134 into which springs 136 are set. A plurality of balls 138 are urged by the springs against the bottom 124 and into the detents 125.

The top faces 140–146 of the rings 114–120 have line indicia 148 which form paths for a playing piece of any suitable type. The top surfaces 140–146 of the rings are flush with each other and with the top 132 of the wall 128.

The operation of the puzzle game is exactly the same as the first embodiment and need not be further explained.

While the invention has been shown and described in detail, with reference to a preferred embodiment thereof, it will be understood to those skilled in the art to which this invention pertains that various changes in the form and detail and scoring method may be made therein without departing from the spirit and scope of the invention.

What is claimed is:

1. A puzzle game apparatus comprising:
a base;
a plurality of steps on the base;
a recessed raceway in the base;
a rotatable ring within said raceway;
a plurality of rotatable rings on the steps;
a center member on a platform above the steps;
a vertical flange extending from the base; and
braking means on the base for the rings.

2. A puzzle game as defined in claim 1, and:
said raceway having a flat bottom surface having a plurality of slots therein, said braking means including a plurality of springs in the slots and a plurality of balls in the slots urged by the springs against the ring in the raceway.

3. A puzzle game as defined in claim 2, and:
detents in the ring cooperating with said urged balls to stop the ring after rotation thereof.

4. A puzzle game as defined in claim 1, wherein:
said rings having slanted surfaces with line indicia thereon for forming a maze across said slanted surfaces of said rings.

5. A puzzle game as defined in claim 4, wherein:
said vertical flange and said center member having slanted surfaces coincident with the slanted surfaces of the rings thus forming a continuous planar surface from the edge of the apparatus to the center member.

6. A puzzle game as defined in claim 1, wherein:
said steps having a plurality of slots therein, said braking means including springs in the slots and balls in the slots urged by said springs against the rotatable rings on the steps.

7. A puzzle game as defined in claim 6, and:
detents in the rings cooperating with the urged balls to stop the rings after rotation thereof.

8. A puzzle game as defined in claim 1, wherein:
said base being pyramid-like in formation and having a hollow conical inner wall and a flat roof.

9. A puzzle game apparatus comprising:
a base having a vertically extending circular flange;
a plurality of rotatable concentric rings on the base within the circular flange, said flange and said rings flush with each other;
biased braking means on the base for randomly stopping the rings; and
line indicia on the rings for creating a maze across said rings in their stopped positions whereby a player attempts to negotiate said maze with a playing piece within a given period of time.

10. A puzzle game apparatus comprising:
a base;
a platform on the base;
a upwardly projecting flange on the base spaced from the platform;
a plurality of concentric rings on the base between the platform and the flange, said rings individually rotatable;
braking means for randomly stopping the rings; and
line indicia on each ring creating a maze across the rings in their stopped positions whereby a player attempts to negotiate the maze with a playing piece within a given period of time.

* * * * *